United States Patent [19]

Schaeflern

[11] 4,156,357

[45] May 29, 1979

[54] CARRIAGE RELEASING MECHANISM FOR A FLAT BED KNITTING MACHINE

[75] Inventor: Henry Schaeflern, Pittstown, N.J.

[73] Assignee: The Singer Company, New York, N.Y.

[21] Appl. No.: 939,582

[22] Filed: Sep. 5, 1978

[51] Int. Cl.[2] ..... D04B 35/10

[52] U.S. Cl. ..... 66/157

[58] Field of Search ..... 66/157, 60, 64, 165

[56] References Cited

U.S. PATENT DOCUMENTS

| | | | |
|---|---|---|---|
| 769,378 | 9/1904 | Hammond | 66/157 |
| 824,565 | 6/1906 | Morris | 66/157 |
| 2,543,547 | 2/1951 | Goodison | 66/157 |
| 2,573,261 | 10/1951 | Harzer | 66/157 |
| 3,719,061 | 3/1973 | Hadam et al. | 66/157 |
| 3,780,542 | 12/1973 | Schieber et al. | 66/165 |
| 3,926,016 | 12/1975 | Flauell | 66/157 |
| 4,064,710 | 12/1977 | Krause | 66/157 |
| 4,079,601 | 3/1978 | Kamikura et al. | 66/75.2 |

FOREIGN PATENT DOCUMENTS

| | | | |
|---|---|---|---|
| 14732 of | 1908 | United Kingdom | 66/157 |

*Primary Examiner*—Ronald Feldbaum

*Attorney, Agent, or Firm*—William V. Ebs; Robert E. Smith; Edward L. Bell

[57] ABSTRACT

A driving connection between a motor driven belt and the carriage of a knitting machine is provided with disengageable parts which separate when the carriage jams and thereby disconnect the carriage from the belt.

6 Claims, 4 Drawing Figures

CARRIAGE RELEASING MECHANISM FOR A FLAT BED KNITTING MACHINE

BACKGROUND OF THE INVENTION

1. Field of the Invention

The invention relates to flat bed knitting machines having motor driven carriages.

2. Description of the Prior Art

It is known as disclosed for example in U.S. Pat. No. 824,565 to provide a flat bed knitting machine with mechanism enabling an operator to disconnect a motor driven carriage from the driving source at any time such that carriage may be moved to one side of the bed and the stitches observed. It is also known as indicated in U.S. Pat. No. 3,780,542 to provide a knitting machine having a motor driven carriage with means for generating an electrical signal when a needle breaks and to utilize such signal to actuate an electromagnetic device effective to disconnect a carriage from the motor drive. In addition, it is known in knitting machines having a motor driven carriage to generate an electrical signal when a difficulty of one sort or another in the operation of the machine occurs, and to utilize such signal to disconnect power from the motor driving the carriage.

SUMMARY OF THE INVENTION

In accordance with the invention, a flat bed knitting machine with a motor drive is provided with a simple mechanical arrangement effective to disconnect the carriage of the machine from a drive belt when movement of the carriage along the bed is impeeded. A driving connection between the motor and carriage is provided with disengageable parts and a spring for holding one of the parts in a position of engagement with the other, but nevertheless yieldable to a position permitting said one part to separate from the other when the carriage jams.

DESCRIPTION OF THE PREFERRED EMBODIMENT OF THE INVENTION

Figure 1:
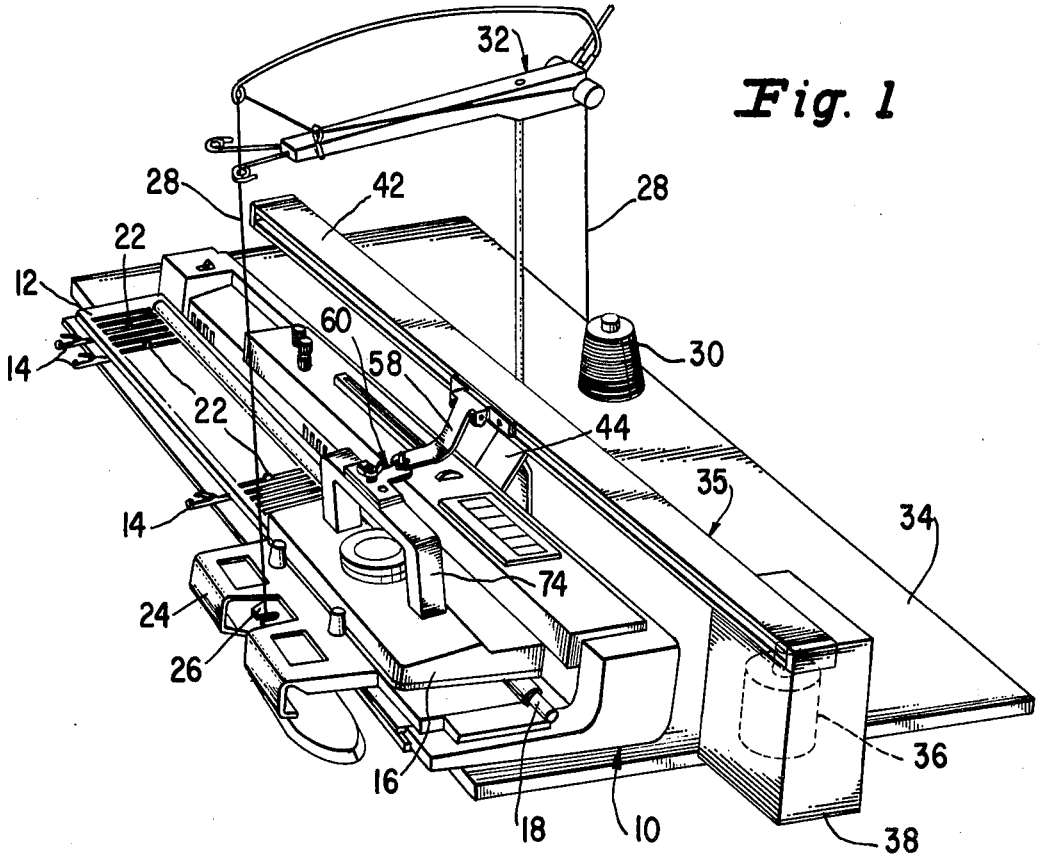
FIG. 1 is a perspective view of a flat bed home type knitting machine equipped with the carriage releasing mechanism of the invention.
Figure 2:
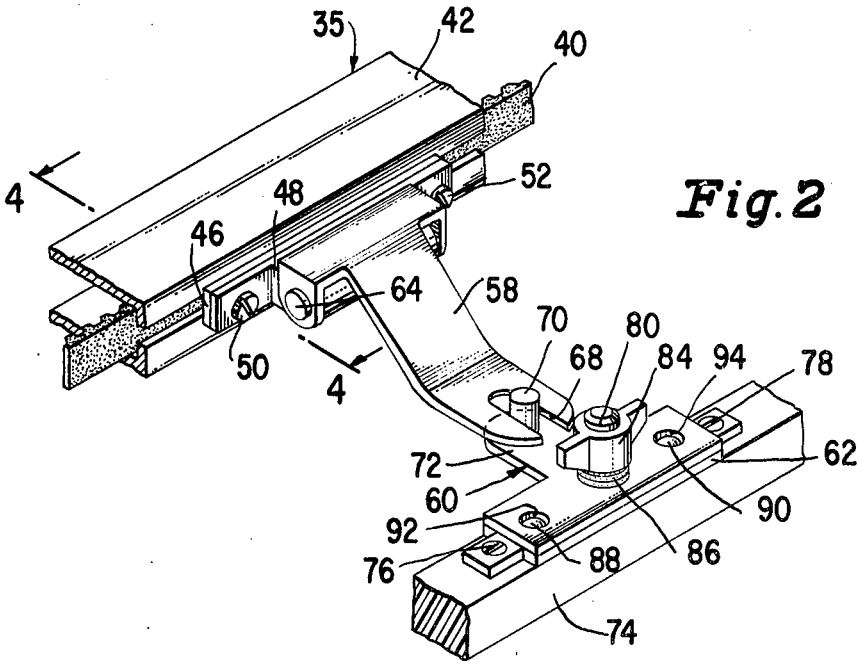
FIG. 2 is an enlarged fragmentary perspective view depicting the said carriage releasing mechanism.
Figure 3:
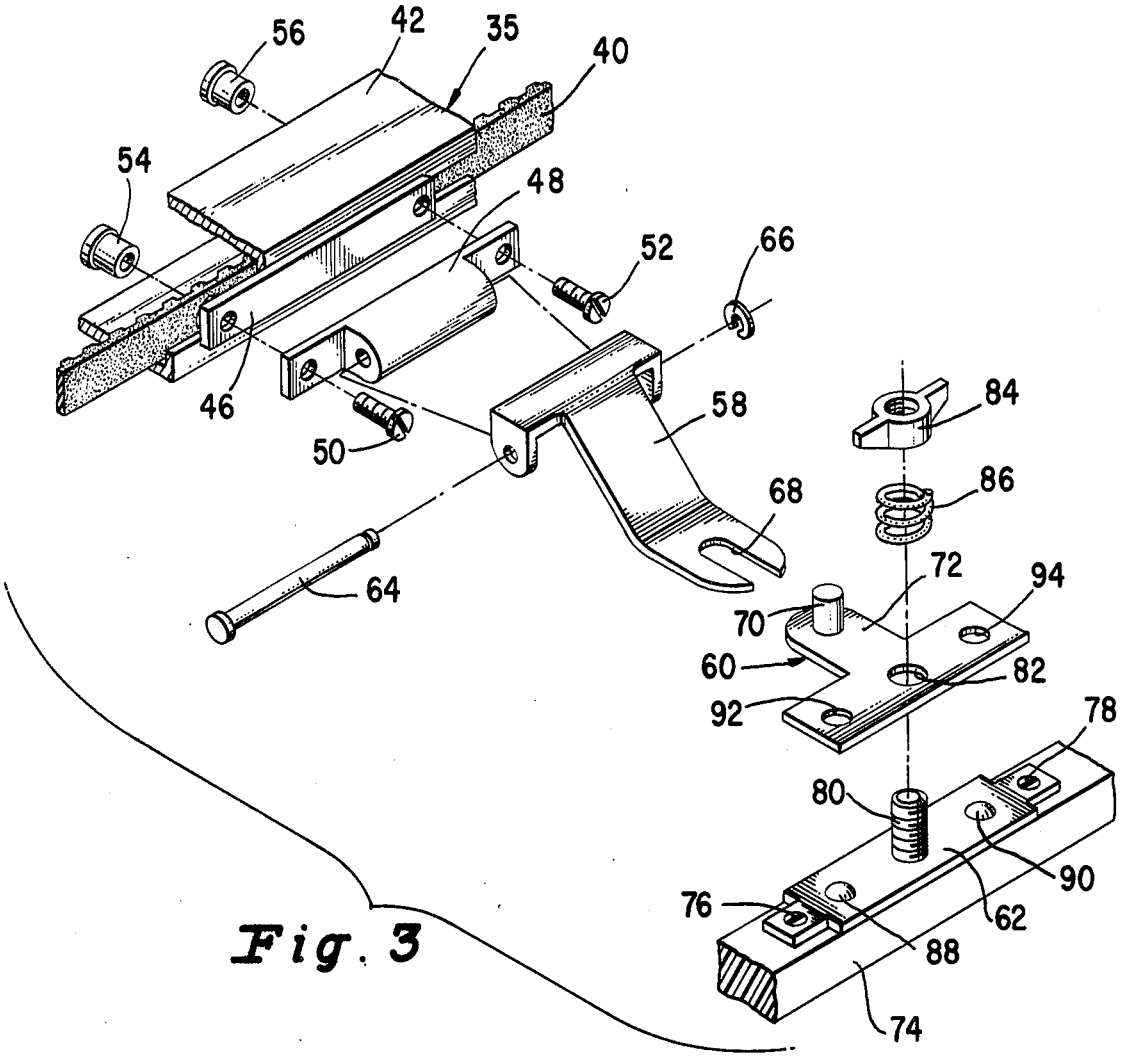
FIG. 3 is an exploded perspective view of the carriage releasing mechanism.
Figure 4:
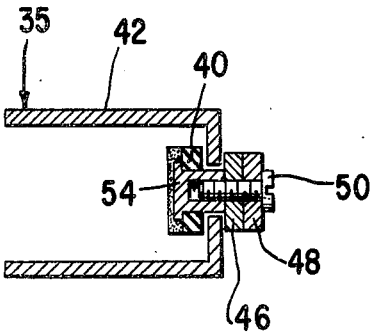
FIG. 4 is a sectional view taken on the plane of the line 4—4 of FIG. 2.

Referring to the drawings, reference character 10 designates a flat bed home type knitting machine including a bed 12 which supports knitting needles 14, and a carriage 16 which is mounted on a tubular member 18 for sliding movement along the bed 12. It is to be understood that the underside of the carriage is provided with cams (not shown) to engage needle butts 22 and so actuate the needles as the carriage is moved on the bed. Reference character 24 designates a yarn presser of conventional design which includes a yarn guide 26 through which yarn 28 is fed to the needles 14. The yarn is supplied from a yarn supply 30 through the usual take up device 32 mounted on a table 34 which also supports the knitting machine 10.

A motor drive unit 35 of conventional design for use in moving the carriage back and forth across the bed 12 includes a motor 36 within a housing 38, and a motor driven belt 40 within a bean 42. The beam supports the motor and is secured to a bracket 44 which is affixed to the table 34.

A driving connection provided between the belt 40 and carriage 16 includes an elongated flat plate 46 which is secured to the belt for sliding movement along the beam, and includes a member 48 which is secured to the belt along with the plate 46, as shown, that is by screws 50 and 52 and threaded flanged sleeves 54 and 56. The said driving connection also includes separable parts 58 and 60, and a plate 62. The part 58 is affixed at an end on number 48 by means of a pin 64 which extends through these pieces to engage a C-ring 66 that prevents axial movement of the pin. The other end of the part 58 is provided with a slot 68 the sides of which are engaged by a pin 70 formed on an arm 72 of separable part 60. Separable part 60 mounts on plate 62 which is fastened to the carriage handle 74 at 76 and 78. As shown, the plate 62 is provided with a central threaded stud 80 which extends through a hole 82 in part 60. The stud 80 is engaged by a winged nut 84 that serves in conjunction with a spring 86 to hold the part 60 during unimpeeded movement of the carriage by the belt 40 in a defined position on the plate 62 as determined by the registration of dimples 88 and 90 on the plate in holes 92 and 94 respectively in separable part 60.

The driving connection between the belt and carriage remains intact to enable the motor to drive the carriage in the absence of an impediment to movement of the carriage. However, if the carriage jams during knitting, the parts 58 and 60 separate to disconnect the carriage from the belt 40 of the motor drive unit whereupon an operator may switch off the motor 36 and take whatever steps may be necessary to remedy the difficulty. Separation of the parts 58 and 60 is effected by relative movement of the parts 58 and 60. While the carriage is prevented from moving, the part 60 is caused to pivot on stud 80 and ride up on the dimples 88 and 90 compressing spring 86 until the part 60 is at the top of the dimples and able to turn without restraint. Part 60 is further pivoted until pin 70 slides free of slot 68 whereupon the drive connection between the drive belt 40 and carriage is severed.

While the knitting machine is operating normally with the carriage 16 being moved back and forth across the machine 12 by an operator, part 60 is maintained in its defined position on plate 62 due to a predetermined downward force exerted on part 60 by spring 86. Such holding force is prescribed by an operator adjusting the position of wing nut 84 on threaded stud 80 as required to assure normal operation in the absence of restraint upon movement of the carriage, but to cause the carriage to be disconnected from the drive belt when movement of the carriage is opposed by an impediment which would otherwise result in damage to the machine.

The foregoing disclosure is representative of a preferred exemplary form and adaptation of the invention, and is to be interpreted as illustrative rather than limiting. It is intended that the invention be accorded the full scope of the claims appended hereto.

I claim:

1. In a flat bed knitting machine the combination comprising a needle supporting bed, a motor driven belt for moving the carriage along the bed and a driving connection between the belt and carriage including a pair of disengageable parts and including spring means for holding one of the said parts in a position of engagement with the other and yieldable to a position permitting said one part to separate from the other when the carriage jams such that the carriage is disconnected from the drive belt.

2. The combination of claim 1 including means for adjusting the holding force of the spring means.

3. The combination of claim 1 wherein one of the said disengageable parts includes a slot and the other part includes a pin which registers in the slot, the pin being moveable out of the slot to disengage the parts when the carriage jams.

4. The combination of claim 1 wherein the spring held part is pivotally mounted in the driving connection and turns when the carriage jams to separate from the other part.

5. The combination of claim 4 wherein the spring held part includes a pin and the other part includes a slot which receives the pin and from which the pin separates to disengage the parts when the carriage jams.

6. The combination of claim 1 including means defining the position of spring held part relative to the other part prior to separation of the parts.

* * * * *